US007854210B2

(12) United States Patent
Moore

(10) Patent No.: US 7,854,210 B2
(45) Date of Patent: Dec. 21, 2010

(54) CLEAN ROOM UTILITY POUCH

(75) Inventor: Loy A. Moore, 55341 Fullerton Rd., Warren, OR (US) 97053

(73) Assignee: Loy A. Moore, Warren, OR (US)

( * ) Notice: Subject to any disclaimer, the term of this patent is extended or adjusted under 35 U.S.C. 154(b) by 704 days.

(21) Appl. No.: 11/810,229

(22) Filed: Jun. 4, 2007

(65) Prior Publication Data

US 2008/0295754 A1 Dec. 4, 2008

(51) Int. Cl.
*D05B 35/06* (2006.01)
*B65D 33/00* (2006.01)

(52) U.S. Cl. ..... 112/475.09; 383/41

(58) Field of Classification Search ..... 112/475.01, 112/475.08, 475.09, 475.17; D3/226; 224/235, 224/682

See application file for complete search history.

(56) References Cited

U.S. PATENT DOCUMENTS 3,678,921 A * 7/1972 Brendgord et al. ..... 600/21
4,146,133 A * 3/1979 Bogorad et al. ..... 206/439
4,671,567 A * 6/1987 Frobose ..... 297/452.42
5,524,802 A * 6/1996 Benson et al. ..... 224/194
6,123,077 A * 9/2000 Bostock et al. ..... 128/206.12
6,571,997 B2 * 6/2003 Dedrick ..... 224/183
2008/0050051 A1 * 2/2008 Palt ..... 383/41

* cited by examiner

*Primary Examiner*—Ismael Izaguirre
(74) *Attorney, Agent, or Firm*—Robert J. Ireland

(57) ABSTRACT

A method of constructing a clean room utility pouch includes cutting dust-proof fabric in accordance with a pattern. The cut edges of the dust proof fabric are treated to eliminate loose particulates or loose fibers along the cut edges. Piping can be secured over the cut edges instead of treating, or in addition to treating the cut edges, and finished by securing the pieces together to form the utility pouch. In some embodiments, a mesh is secured to the cut edges to form a portion of the utility pouch. Air can then flow into and out of the pouch via a pouch opening and the mesh.

21 Claims, 11 Drawing Sheets

CLEAN ROOM UTILITY POUCH

CROSS-REFERENCE TO RELATED APPLICATIONS

None

STATEMENT REGARDING FEDERALLY SPONSORED RESEARCH OR DEVELOPMENT

This invention is not the product of any Federally Sponsored Research or Development.

REFERENCE TO MICROFICHE APPENDIX

Not Applicable

FIELD

This invention relates to a clean room utility pouch that emits a low number of airborne particulates. In particular, certain embodiments relate to a clean room utility pouch that emits a low number of airborne particulates from fabric edges cut during manufacture of the pouch.

BACKGROUND

Clean room garments worn by workers in special sensitive environments, such as industrial clean rooms of manufacturers of semiconductors, integrated circuits, etc. or bio-clean rooms of the food and pharmaceutical industries, must emit a low number of airborne particulates. Garments used in clean rooms feature anti-dust, anti-particulate, anti-static, and sweat-absorbency properties. Many clean room garments are made of a synthetic material, such as a polyester material.

One design consideration in manufacturing a clean room garment is the extent to which the garment will emit particles or particulates into the air of a clean room. Another design consideration is the extent to which a garment meets clean room requirements while still having desired functionality.

DETAILED DESCRIPTION

Figure 1:
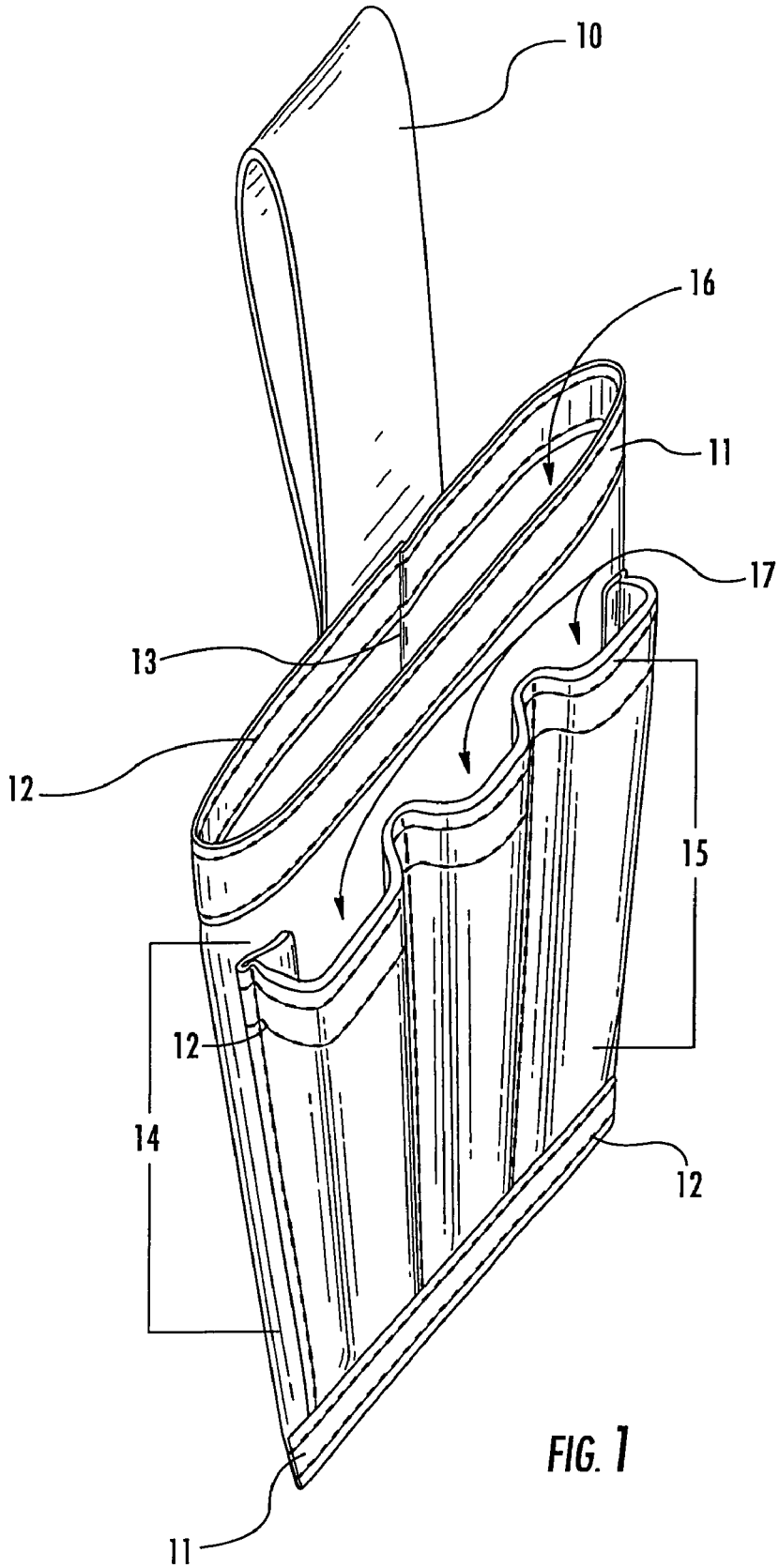
FIG. 1 is a perspective view of one embodiment of a clean room utility pouch.
Figure 2:
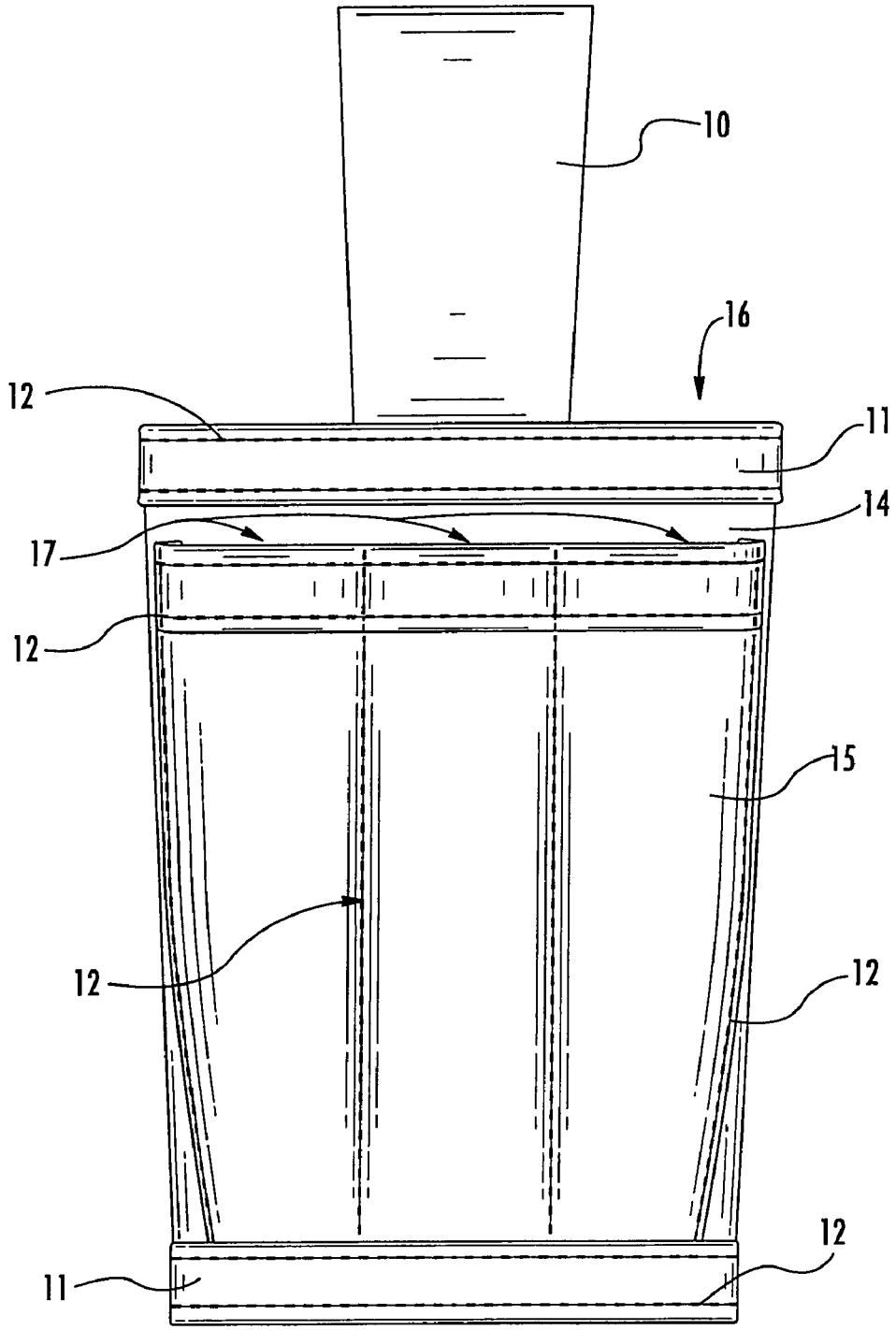
FIG. 2 is a front side view of the embodiment of the clean room utility pouch as shown in FIG. 1.
Figure 3:
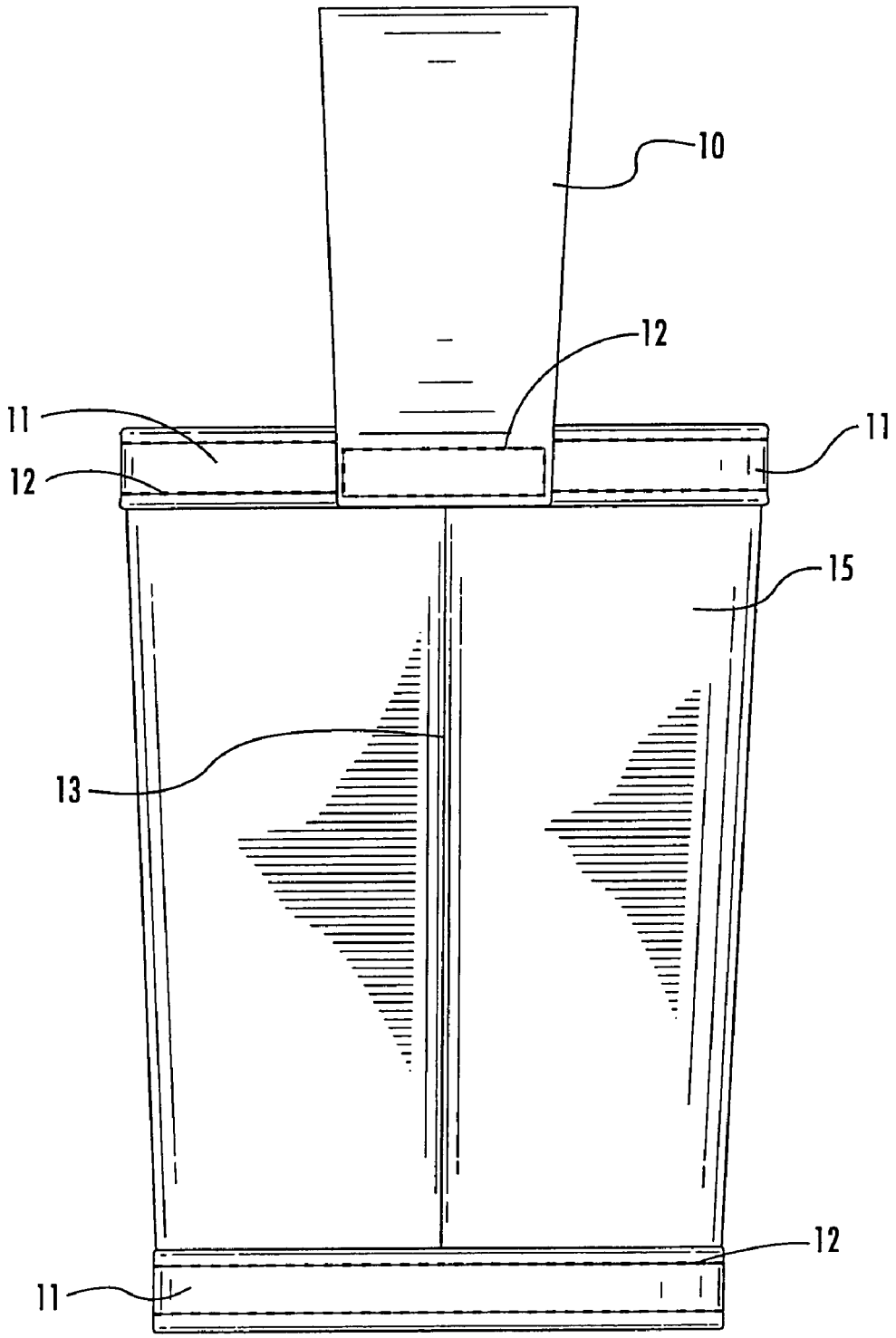
FIG. 3 is a rear side view of the embodiment of the clean room utility pouch as shown in FIG. 1.
Figure 4:
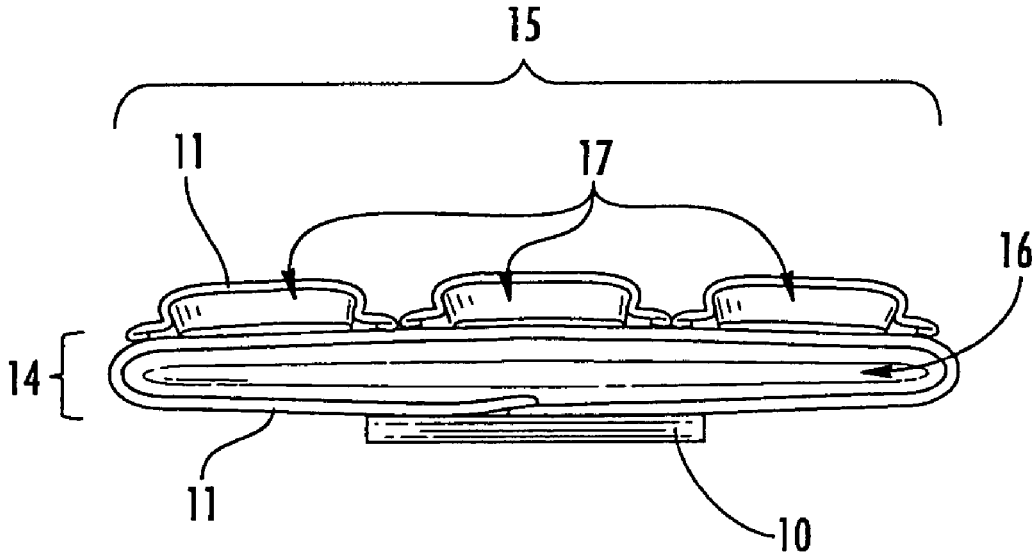
FIG. 4 is a top side view of the embodiment of the clean room utility pouch as shown in FIG. 1.
Figure 5:
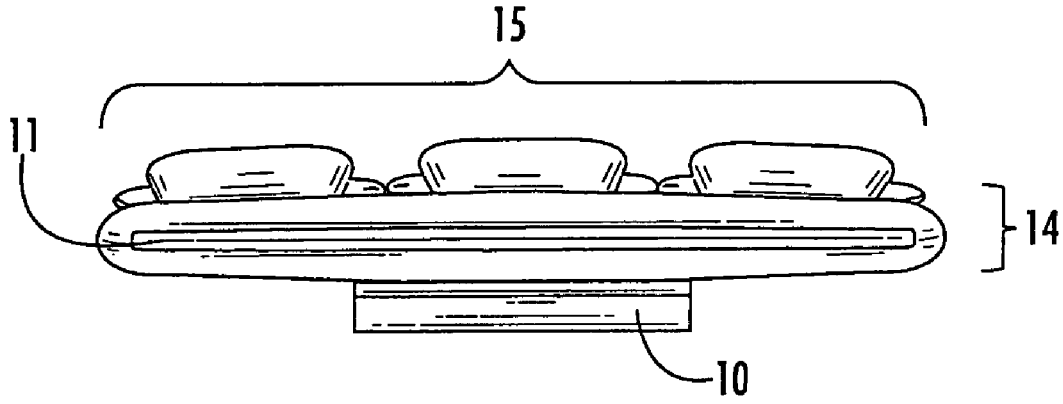
FIG. 5 is a bottom side view of the embodiment of the clean room utility pouch as shown in FIG. 1.
Figure 6:
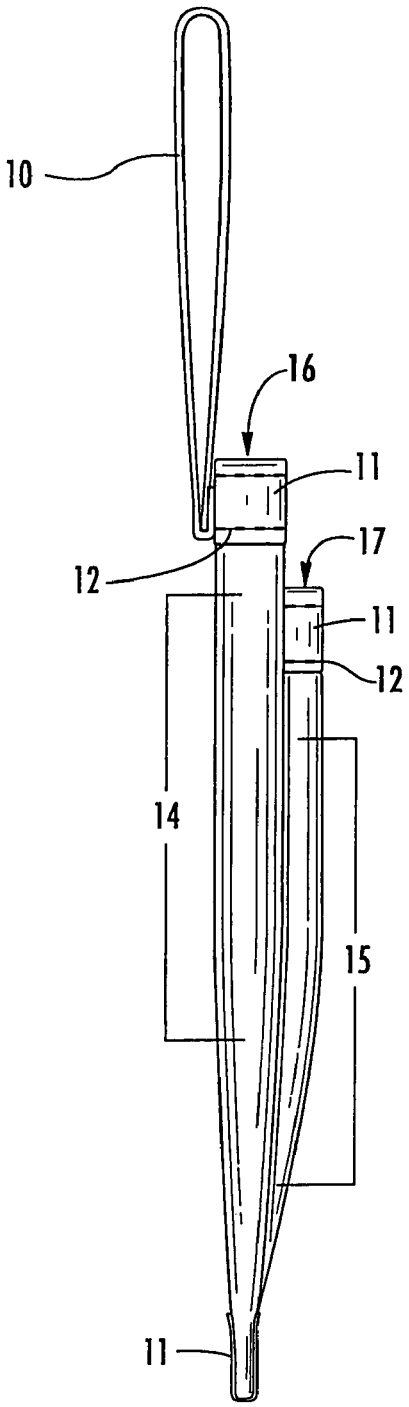
FIG. 6 is a right side view of the embodiment of the clean room utility pouch as shown in FIG. 1.
Figure 7:
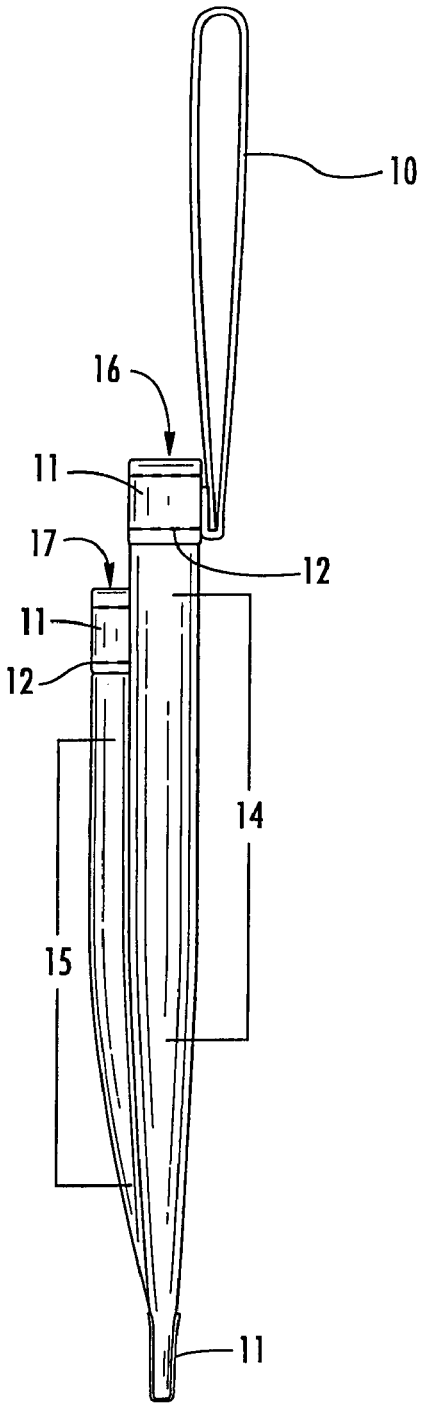
FIG. 7 is a left side view of the embodiment of the clean room utility pouch as shown in FIG. 1.
Figure 8:
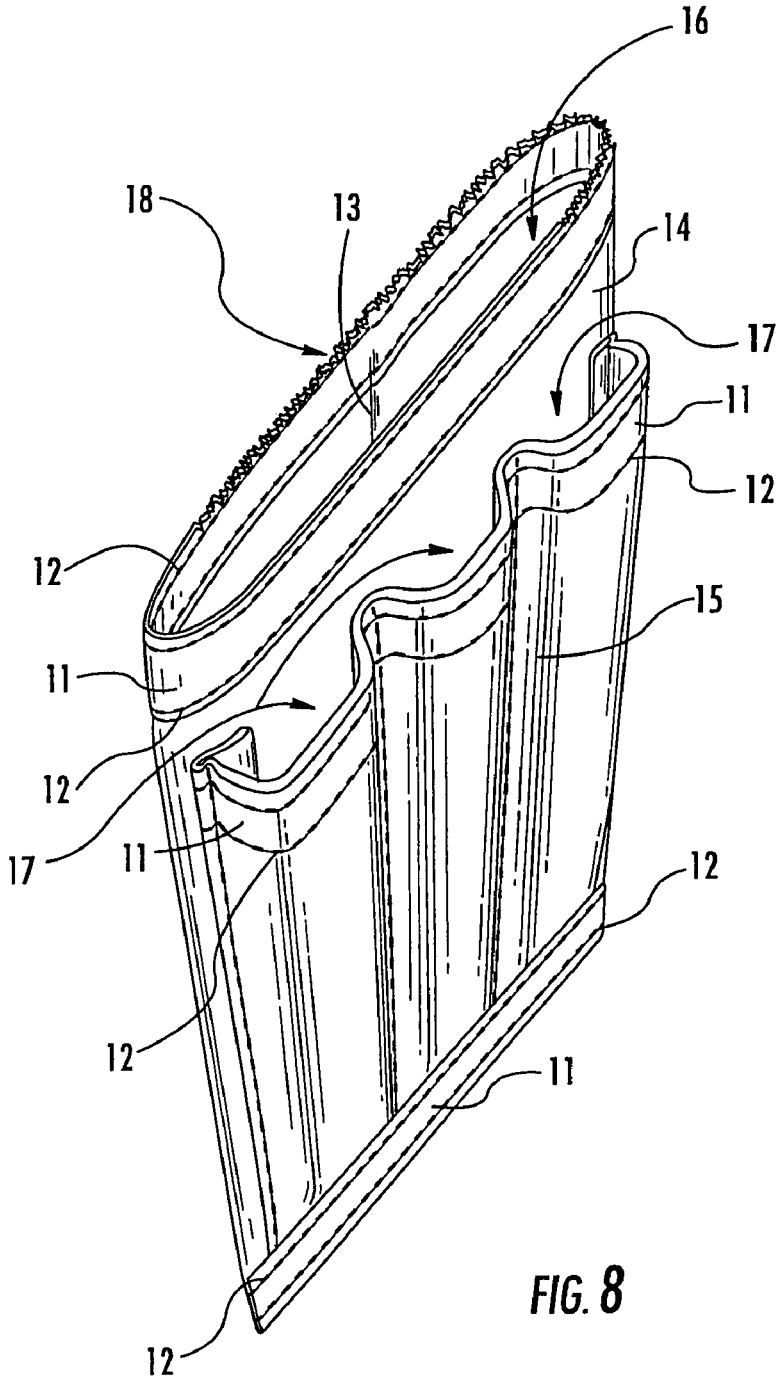
FIG. 8 is a cut-away view of the embodiment of the clean room utility pouch as shown in FIG. 1, demonstrating a cut edge of the fabric.

In described embodiments, a clean room utility pouch emits a sufficiently low number of airborne particulates to be suitable for use in a clean room. In some embodiments, a clean room utility pouch emits a low number of airborne particulates from edges cut during manufacture of the utility pouch. In some embodiments, a clean room utility pouch includes a pouch opening and a mesh, allowing air to be blown through the pouch via the pouch opening and the mesh.

Certain embodiments are described as comprising a dust-free or a dust-proof fabric. The terms dust-free fabric or dust-proof fabric do not necessarily refer to a fabric that is absolutely dust-free or dust-proof. These terms include a fabric that is sufficiently dust-free or dust-proof to be suitable for use in a clean room, such as a semiconductor manufacturing clean room or a bio-clean room in the food or pharmaceutical industries. In some embodiments, such a fabric includes a polyurethane material, a polyester material, or other material approved for use in a clean room.

In some embodiments, a dust-free or dust-proof fabric is sufficiently dust-free or dust proof to be suitable for use in a clean room complying with a classification defined by, for example, a version of Federal Standard 209. In one embodiment, a dust-free or dust-proof fabric is sufficiently dust-free to be suitable for use in a class 10 clean room, as defined by, for example, a version of Federal Standard 209.

In some embodiments, a dust-free or dust-proof fabric is suitable for use in a clean room required to contain, per cubic foot, less than 350 particles or particulates of a size greater than 0.1 microns, less than 30 particles or particulates of a size greater than 0.3 microns, and less than 10 particles or particulates of a size greater than 0.5 microns.

In some embodiments, the dust-free or dust-proof fabric is a non-static fabric. Such a fabric may also have sweat-absorbency and other characteristics consistent with use in a clean room.

Referencing FIGS. 1-8, in one embodiment, a clean room utility pouch 8 is constructed from a dust-free or dust-proof fabric, such as polyurethane. The clean room utility pouch 8 includes a first portion 14, arranged and constructed to define a pouch opening 16 adhered together along a long seam 13.

The clean room pouch 8 further includes a second portion 15, arranged and constructed to define a plurality of pocket openings 17. Piping 11 covers cut edges (e.g., cut edge 18 of FIG. 8) of the first portion 14 and the second portion 15. These cut edges may be formed during the cutting of the fabric during the manufacturing process. The piping covers and contains any loose particulates or loose fibers along the cut edges.

Stitching 12, secures the second portion 15 to the first portion 14. Stitching 12 also secures the piping 11 to the first portion 14 and the second portion 15. In particular, stitching 12 secured the piping 11 to top edges of the first portion 14 (top of pouch opening 16) and the second portion 15 (top of pocket openings 17). Stitching also secures the piping 11 to the bottom edges of the first portion 14 and the second portion 15.

The clean room pouch 8 further includes a suspender 10 fixedly attached to the first portion 14, facilitating connection of the pouch 8 to a belt or other article of clothing (not shown) of the wearer.

Although the embodiment described above with reference to FIGS. 1-8 includes a second portion, in some embodiments, a pouch does not include a second portion with pockets. Further, although the embodiment described above with reference to FIGS. 1-8 includes a suspender, in some embodiments, a pouch does not include a suspender attached to a first portion.

Also, although the above-described embodiment includes piping covering edges, in other embodiments, a pouch does not include piping. In some embodiments without piping, edges (e.g., edge 18 of FIG. 8) are treated to eliminate any loose particulates or loose fibers along the edges.

Figure 9:
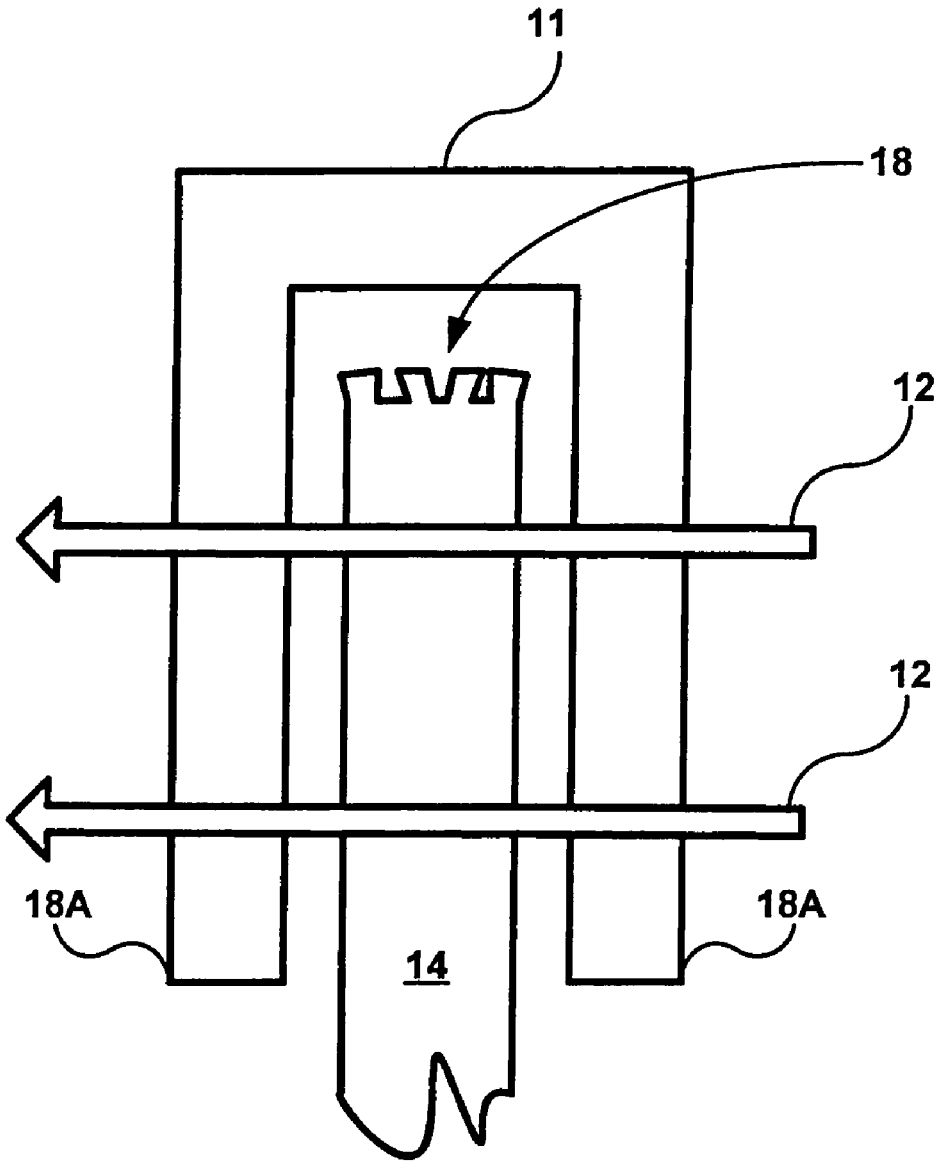
FIG. 9 is a two-dimensional, cross-sectional view of piping secured over a cut fabric edge, consistent with some embodiments.

Referencing FIG. 9, in one embodiment, a first portion 14 of a pouch (e.g., pouch 8 of FIGS. 1-8) includes a cut edge 18 formed from cutting of fabric during manufacture of the pouch. Cut edge 18 is a potential source of airborne particulates from loose particulates or loose fibers along cut edge 18. Cut edge 18 is covered by piping 11 to cover and contain the potential loose particulates or loose cut fibers along cut edge 18. The piping 11 has edges 18A, which are not covered or treated. Treated piping edges are discussed below with reference to FIG. 10.

In the embodiment shown in FIG. 9, the piping 11 is secured over cut edge 18 of first portion 14 of the pouch by stitching 12. In another embodiment, piping is secured over cut edge 18 of first portion 14 by taping piping to first portion 18.

Figure 10:
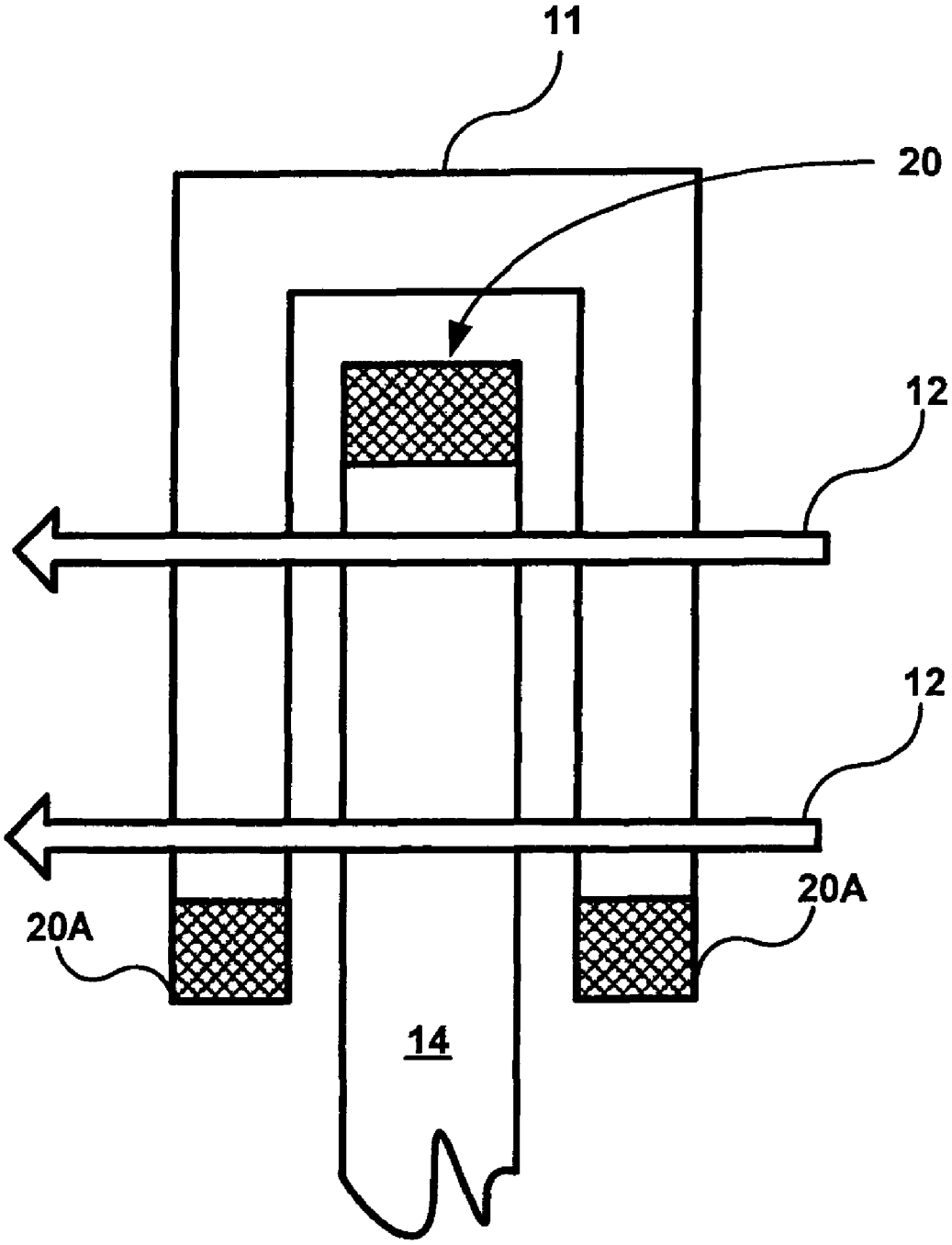
FIG. 10 is a two-dimensional, cross-sectional view of piping secured over a treated cut fabric edge, the piping having treated edges, consistent with some embodiments.

Referencing FIG. 10, in one embodiment, a first portion 14 of a pouch (e.g., pouch 8 of FIGS. 1-8) includes a treated edge 20. Edge 20 is treated to eliminate at least some potential loose particulates or loose fibers along the edge.

In the embodiment shown in FIG. 10, piping 11 is secured over treated edge 20 of first portion 14 of the pouch by stitching 12. In another embodiment, piping is secured over treated edge 20 of first portion 14 by taping piping to first portion 14. The piping 11 covers and contains potential loose particulates or loose fibers along treated edge 20 that remain after treatment of edge 20. In an alternative embodiment, there is no piping covering treated edge 20.

In the embodiment shown in FIG. 10, piping 11 has treated edges 20A. Edges 20A are treated to eliminate potential loose particulates or loose fibers along the edges of piping 11. In an alternative embodiment, the edges of piping 11 are not treated.

Figure 11:
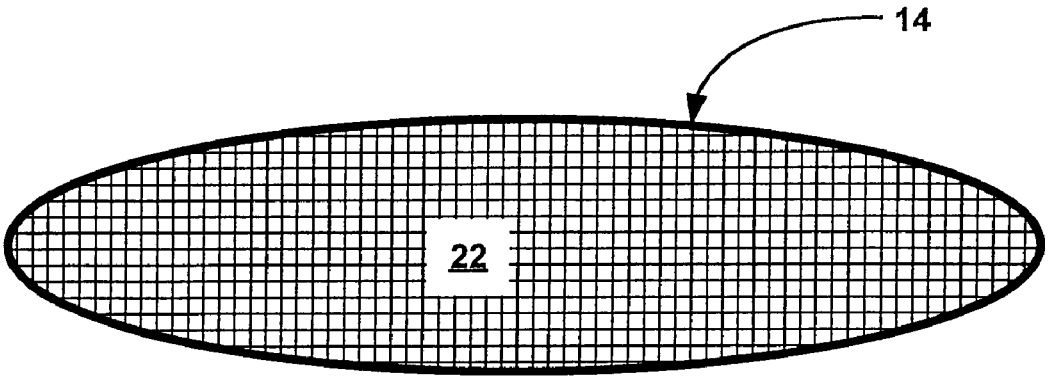
FIG. 11 a bottom view of a clean room utility pouch showing a mesh secured to the bottom of the pouch, consistent with some embodiments.

Referencing FIG. 11, in one embodiment, a clean room utility pouch includes a mesh 22 secured to the bottom of a first portion 14 of a pouch. The mesh 22 may allow air to flow from outside a pouch, into a pouch opening (e.g., pouch opening 16 of FIGS. 1-8), through the pouch, and out of the bottom of the pouch via mesh 22. This may occur for example, when flushing a pouch with forced air to remove loose particle or particulates before the pouch is introduced into a clean room. Thus, an air passageway is formed in and out of a pouch via a pouch opening and a mesh.

Figure 12:
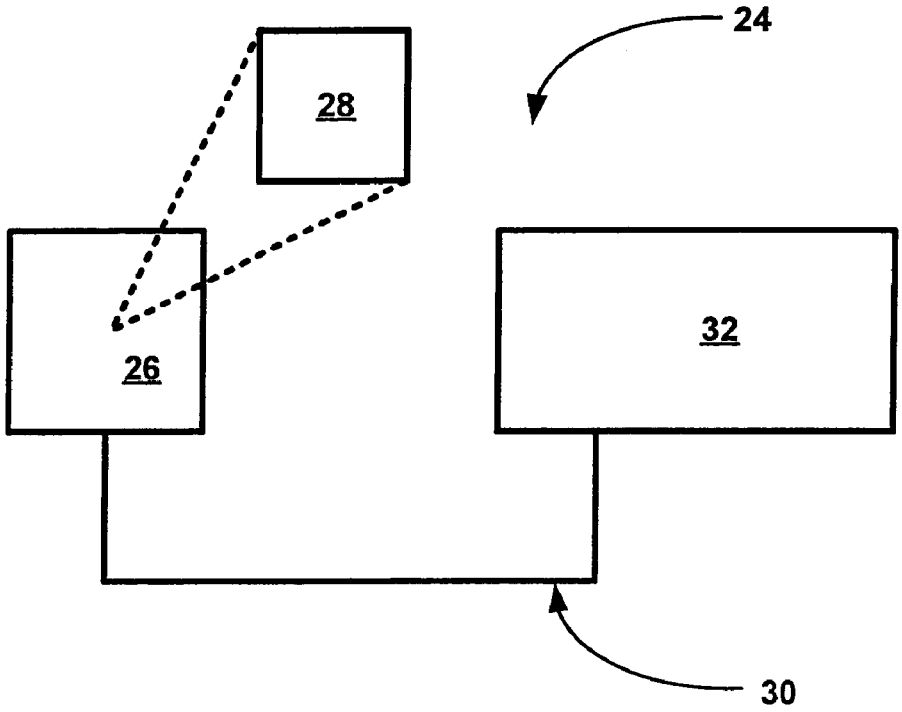
FIG. 12 is a block diagram of an exemplary system that may be used to provide a pattern and to cut fabric in accordance with the pattern, consistent with some embodiments.

Referencing FIG. 12, an exemplary system 24 for manufacturing a clean room utility pouch according to some embodiments includes a memory 26 that includes computer readable media storing computer executable instructions. In one embodiment, memory 26 includes a nonvolatile memory, such as a floppy disk. In one embodiment, memory 26 includes a volatile memory, such as a type of dynamic random access memory.

In the embodiment shown, the stored computer executable instructions define a pattern 28 of a desired clean room utility pouch. In one further embodiment, pattern 28 includes a pattern for a first portion of a pouch (e.g., first portion 14 of FIGS. 1-8). In one further embodiment, pattern 28 includes a pattern for a second portion—e.g., with pockets—of a pouch (e.g., second portion of FIGS. 1-8).

Exemplary system 24 further includes a bus or interconnect 30 that communicably couples memory 26 to an automated fabric cutter 32. Automated fabric cutter 32 reads computer executable instructions stored in memory 26 via interconnect 30 and cuts dust-free or dust-proof fabric in accordance with pattern 28.

Figure 13:
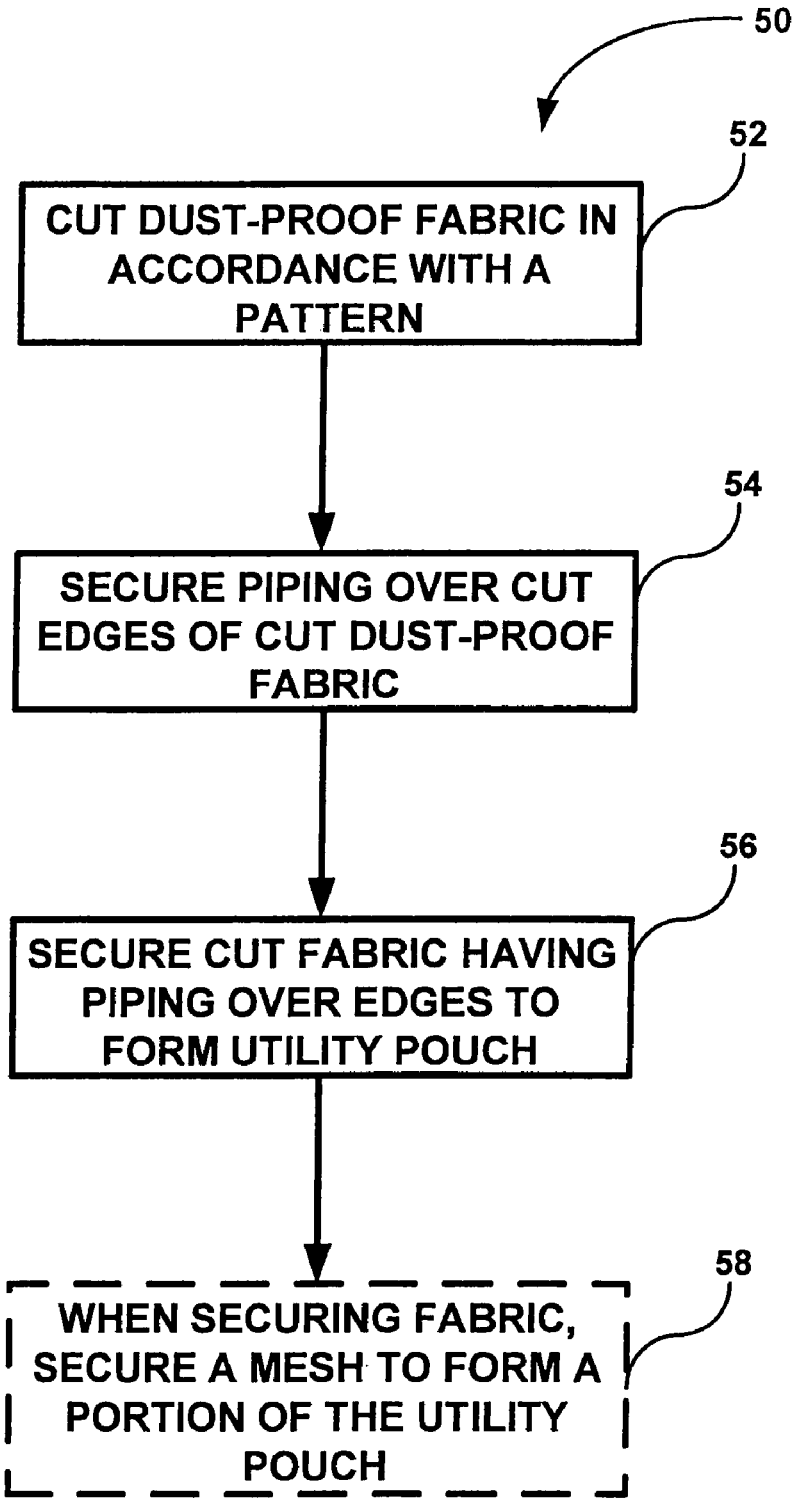
FIG. 13 is a flow chart illustrating a method of manufacturing a clean room utility pouch consistent with certain embodiments, the method including securing piping over cut edges of a dust-proof fabric.

Referencing FIG. 13, a method 50 of manufacturing a clean-room utility pouch consistent with some embodiments includes cutting a dust-proof fabric in accordance with a pattern (Process Block 52). In one embodiment, the pattern is provided by a memory (e.g., memory 26 of FIG. 12) storing the pattern as computer executable instructions. In a further embodiment, the cutting is performed automatically by a machine that reads the computer executable instructions (e.g., automated fabric cutter 32 of FIG. 12).

The cutting produces cut edges. In exemplary method 50, piping is secured over the cut edges of the cut dust-proof fabric to cover and contain any loose particulates or loose cut fibers along the cut edges (Process Block 54). In one embodiment, the piping is secured over the cut edges by taping the piping over the edges. In one embodiment, the piping is secured over the cut edges by stitching the piping over the edges.

Continuing with method 50, the cut dust-proof fabric having piping on the cut edges is secured together to form a utility pouch (Process Block 56). In one embodiment, securing the cut edges includes defining a pouch opening in the utility pouch. The securing optionally includes securing a mesh to a portion of the cut fabric to form a portion of the utility pouch (Process Block 58).

Figure 14:
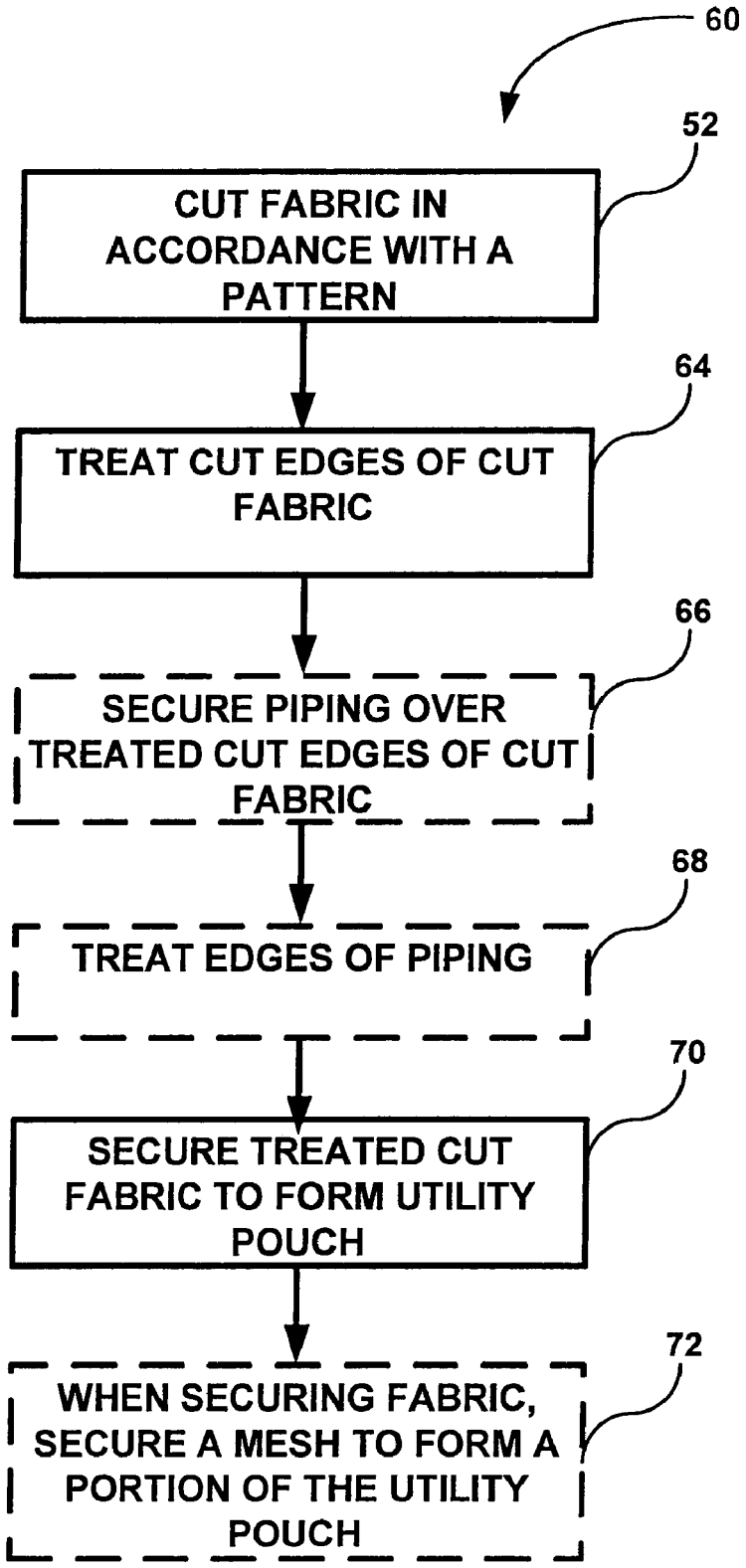
FIG. 14 is a flow chart illustrating a method of manufacturing a clean room utility pouch consistent with certain embodiments, the method including treating cut edges of a dust-proof fabric.

Referencing FIG. 14, a method 60 of manufacturing a clean-room utility pouch consistent with some embodiments includes cutting a dust-proof fabric in accordance with a pattern (Process Block 52). The cut edges of the cut dust-proof fabric are treated to eliminate at least some loose particulates or loose cut fibers along the cut edges (Process Block 64). In one embodiment, the treatment of the cut edges includes heat treating the cut edges to melt at least a portion of the cut edges. In one embodiment, the treatment of the cut edges includes chemical treating the cut edges, for example, by applying gum or glue to the cut edges.

In some embodiments, the piping is optionally secured over the treated edges of the cut dust-proof fabric (Process Block 66). The treating of the cut edges may be performed before the securing of the piping over the cut edges.

In some embodiments, edges of the piping are optionally treated to eliminate loose particulates or loose fibers along piping edges (Process Block 68). As discussed above regarding treating cut edges of a fabric, in some embodiments the treating of piping edges may include heat treating or chemical treating.

Continuing with method 60, the treated, cut, dust-proof fabric is secured together to form a utility pouch (Process Block 70). In one embodiment, securing the cut edges includes defining a pouch opening in the utility pouch. The securing optionally includes securing a mesh to a portion of the treated cut fabric to form a portion of the utility pouch (Process Block 58).

Some embodiments, manufactured according to one or more of the methods described above, release a sufficiently low number of airborne particulates to be suitable for use in a semiconductor manufacturing clean room that complies with one or more industry or government standards. For example, a particular embodiment may be suitable for use in a clean room that per cubic foot must, consistent with an industry or government standard, contain no more than 350 airborne particulates having a size greater than 0.1 microns.

At time reference is made to "one embodiment" or to "some embodiments." All the embodiments referred to as "one embodiment" or "some embodiments" are not necessarily the same embodiment or embodiments.

The foregoing embodiments and advantages are merely exemplary and are not to be construed as limiting the present invention. Those skilled in the art can appreciate from the foregoing description that the techniques of the embodiments of the invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A method of manufacturing a clean room utility pouch, the method comprising:

cutting a dust-proof fabric in accordance with a pattern;

securing piping over cut edges of the cut dust-proof fabric to cover and contain at least one of loose particulates and loose cut fibers along the cut edges; and securing the cut dust-proof fabric, having piping over the cut edges, together to form the utility pouch.

2. The method of claim 1 wherein securing the piping over the cut edges comprises taping the piping over the cut edges.

3. The method of claim 1 wherein securing the piping over the cut edges comprises stitching the piping over the cut edges.

4. The method of claim 1 further comprising treating the cut edges of the cut dust-proof fabric to eliminate at least one of loose particulates and loose cut fibers along the cut edges.

5. The method of claim 4, wherein the treating of the cut edges is performed before the securing of the piping over the cut edges.

6. The method of claim 5, wherein the piping has edges and the method further comprises treating the piping edges to eliminate at least one of loose particulates and loose fibers along the piping edges.

7. The method of claim 1 wherein securing the cut and treated dust-proof fabric to form the utility pouch includes:

defining a pouch opening; and securing a mesh to a portion of the cut fabric to form a portion of the utility pouch;

wherein the pouch opening is defined and the mesh is secured to define an air passageway in and out of the pouch via the opening and the mesh.

8. A method of manufacturing a clean room utility pouch, the method comprising:

cutting a dust-proof fabric in accordance with a pattern;

treating cut edges of the cut dust-proof fabric to eliminate at least one of loose particulates and loose cut fibers along the cut edges;

securing piping over the treated and cut edges of the cut dust-proof fabric to cover and contain at least one of loose particulates and loose cut fibers along the treated and cut edges; and, securing the cut dust-proof fabric, having piping over the treated and cut edges, together to form the utility pouch.

9. The method of claim 8, wherein the treating of the cut edges comprises applying at least one of a glue and a gum product to the cut edges.

10. The method of claim 8, wherein the treating of the cut edges comprises heat treating the cut edges.

11. The method of claim 8 wherein securing the cut and treated dust-proof fabric to form the utility pouch includes:

defining a pouch opening; and securing a mesh to a portion of the cut fabric to comprise a portion of the utility pouch;

wherein the pouch opening is defined and the mesh is secured to define an air passageway in and out of the pouch via the opening and the mesh.

12. The method of claim 8, wherein the formed utility pouch releases a sufficiently low number of airborne particulates to be suitable for use in a semiconductor manufacturing clean room in which, consistent with a clean room standard, contains, per cubic foot, no more than 350 airborne particulates having a size greater than 0.1 microns.

13. The method of claim 8, wherein the dust-proof fabric comprises a non-static fabric.

14. A method of manufacturing a clean room utility pouch, the method comprising:

cutting a dust-proof fabric in accordance with a pattern;

treating cut edges of the cut dust-proof fabric to eliminate at least one of loose particulates and loose cut fibers along the cut edges;

forming the dust-proof fabric into a utility pouch; and, securing the cut, treated and formed dust-proof fabric together.

15. The method of claim 14, further comprising providing the pattern, wherein the pattern comprises computer-executable instructions stored on a computer-readable medium and wherein the cutting is performed automatically by a machine that reads the stored computer-executable instructions.

16. The method of claim 14, wherein the dust-proof fabric comprises a fabric whose use in a semiconductor manufacturing clean room is compatible with the clean room's compliance with a clean room classification defined by a version of Federal Standard 209.

17. The method of claim 14, wherein treating the cut edges comprises heat treating the edges to melt at least a portion of the cut edges.

18. The method of claim 14, wherein treating the cut edges comprises chemically treating the edges, the chemical treating including applying at least one of a gum and a glue to the cut edges.

19. The method of claim 14, further comprising securing piping over the treated edges of the cut dust-proof fabric.

20. The method of claim 14 wherein securing the cut and treated dust-proof fabric to form the utility pouch includes:

defining a pouch opening; and securing a mesh to a portion of the cut fabric to form a portion of the utility pouch;

wherein the pouch opening is defined and the mesh is secured to define an air passageway in and out of the pouch via the opening and the mesh.

21. The method of claim 14 wherein securing the cut and treated dust-proof fabric to form the utility pouch includes:

defining a loop suspender from the dust-proof fabric; and securing the loop suspender to the utility pouch;

wherein the loop suspender provides secure connection to the user.

* * * * *